US007009580B2

(12) United States Patent
Leung

(10) Patent No.: US 7,009,580 B2
(45) Date of Patent: Mar. 7, 2006

(54) SOLID STATE LIGHTING ARRAY DRIVING CIRCUIT

(75) Inventor: Wa-Hing Leung, New Territories (HK)

(73) Assignee: Cotco Holdings, Ltd., New Territories (HK)

( * ) Notice: Subject to any disclaimer, the term of this patent is extended or adjusted under 35 U.S.C. 154(b) by 238 days.

(21) Appl. No.: 10/085,129

(22) Filed: Mar. 1, 2002

(65) Prior Publication Data

US 2003/0164809 A1 Sep. 4, 2003

(51) Int. Cl.
*G09G 3/14* (2006.01)

(52) U.S. Cl. ..... 345/46; 340/912

(58) Field of Classification Search ..... 340/815.53, 340/912; 345/39, 44, 46, 82, 83; 362/29, 362/498, 499, 555

See application file for complete search history.

(56) References Cited

U.S. PATENT DOCUMENTS 4,065,716 A * 12/1977 O'Brien ..... 324/96
5,457,450 A * 10/1995 Deese et al. ..... 340/912

* cited by examiner

*Primary Examiner*—Kent Chang
(74) *Attorney, Agent, or Firm*—Jacobson Holman PLLC

(57) ABSTRACT

A solid-state lighting array driving circuit in which a plurality of solid-state lighting devices such as LEDs are rearranged in a reconfigurable circuit. The circuit may be changed to incorporate the LEDs into a larger or fewer number of parallel circuits each containing less or more LEDs themselves respectively. The reconfiguration may be done as a result of variable input voltages such that the circuit may reconfigure to provide a preferred number of LEDs in each circuit for the sensed voltage in the circuit.

3 Claims, 6 Drawing Sheets

SOLID STATE LIGHTING ARRAY DRIVING CIRCUIT

FIELD OF THE INVENTION

This invention relates to a solid state lighting array driving circuit which, in particular, although not necessarily solely, is intended for use with automobiles. The driving circuit may be used for other lighting situation, particularly where the power supply may fluctuate.

BACKGROUND TO THE INVENTION

Some lighting circuit such as those used for lights on automobiles traditionally used conventional light bulbs. For example, the taillight, park-light and indicator-lights provided at the rear of a motor vehicle would include a number of light bulbs in parallel circuits powered by a DC-powered supply from the vehicle.

There are advantages in utilizing solid-state devices for such lights as solid-state devices have significantly longer life expectancies and reduce the need for bulb replacement and risk of failure of the lights.

In using solid-state lighting devices, an array of such devices may be provided such as an array of LEDs. The LEDs are generally driven at constant current to ensure the correct illumination from the LEDs and each of the devices will have a power demand and voltage drop across the device. With a single LED being relatively small and its total light output being insufficient for such lights, it is typical to supply an array of such LEDs to form a single light.

The difficulty with incorporating solid-state devices such as LEDs in automotive uses is that the power supply from a vehicle may fluctuate to some considerable degree. For example, an automotive power supply may provide variable voltages between 6 and 26 volts. Different voltages will be available depending on different states of the battery or generator in the vehicle at any particular time or the instantaneous load drawn from the overall power supply.

With the LEDs operating on constant currents, it is typical to require some kind of power converter and regulator to ensure that the LEDs are driven at the appropriate current and with sufficient voltage. Usually these would require ensuring that the lighting array can operate at the lower end of the likely range of supply voltages and if the voltage is higher, the excess power may be wasted and requires dissipation as heat.

Different circuits have been proposed to provide greater efficiencies. For example, linear regulator circuits can provide the necessary control over the power supply although are relatively inefficient.

An alternative is a switching power supply but such power supplies can cause high electromagnetic interference through the high-speed switching of the device.

OBJECT OF THE INVENTION

It is an object of the present invention to provide a driving circuit for a solid-state lighting array that can deal with fluctuating supply voltages while reducing the inefficiencies and minimizing the problems of heat dissipation or electromagnetic interference. At a minimum, it is an object of the present invention to provide the driving circuit for solid-state lighting arrays that provides the public with a useful choice.

SUMMARY OF THE INVENTION

Accordingly, in a first aspect, the invention may broadly be said to consist in a driving circuit for a solid-state lighting array comprising:

- means for connection of said circuit to an incoming direct current supply;
- a plurality of solid-state lighting devices arranged in one or more series circuits with said means for connection to said power supply;
- at least one switchable parallel current path from said means for connection to said power supply to an intermediate point along at least one of said series circuits to form an alternative set of series circuits;
- at least one current regulating device in circuit with said one or more series circuits;
- a voltage sensor; and
- a control means to control a switch in said switchable parallel path such that said array of lighting devices may be reconfigured into said alternative set of series circuits to alter the quantity of lighting devices in one or more of said series circuits in response to changes in the voltage in the circuits.

Accordingly, in a second aspect, the invention may broadly be said to consist in a method of controlling a solid-state lighting array comprising the steps of:

- sensing a voltage supply to or in circuits through an array of solid-state lighting devices;
- providing at least a first serial path through said solid-state lighting devices;
- providing at least one switchable parallel input intermediate of the ends of said serial path;
- providing at least one current regulating device in circuit with said lighting devices; and
- sensing the incoming voltage and controlling switches on said parallel path to break the serial path into at least two parallel paths each containing a lesser number of solid state lighting devices than said serial path should the voltage drop below a pre-determined threshold.

Accordingly, in a third aspect, the invention may broadly be said to consist in a circuit containing solid-state lighting devices comprising:

- at least one serial path through said solid-state lighting devices;
- at least two alternative parallel paths through said solid-state lighting devices;
- at least one current regulating device in circuit with said lighting devices;
- switching means to switch said circuit from said serial path to a plurality of parallel paths containing a reduced load of lighting devices in each path; and
- control means to control said switches in response to detected voltage within said circuit.

Accordingly, in a further aspect, the invention may broadly be said to consist in a method of providing a circuit containing solid-state lighting devices comprising:

- arranging said solid-state lighting devices into a plurality of alternative circuits connected to at least one current regulating device; and
- switching between said alternative circuits to increase or decrease the number of circuits available and hence the number of solid-state lighting devices in each circuit in response to variations in the power available to the total number of circuits.

BRIEF DESCRIPTION OF THE DRAWINGS

A preferred embodiment of the invention will now be described with reference to the following drawings in which.

DETAILED DESCRIPTION OF PREFERRED EMBODIMENTS

Figure 1:
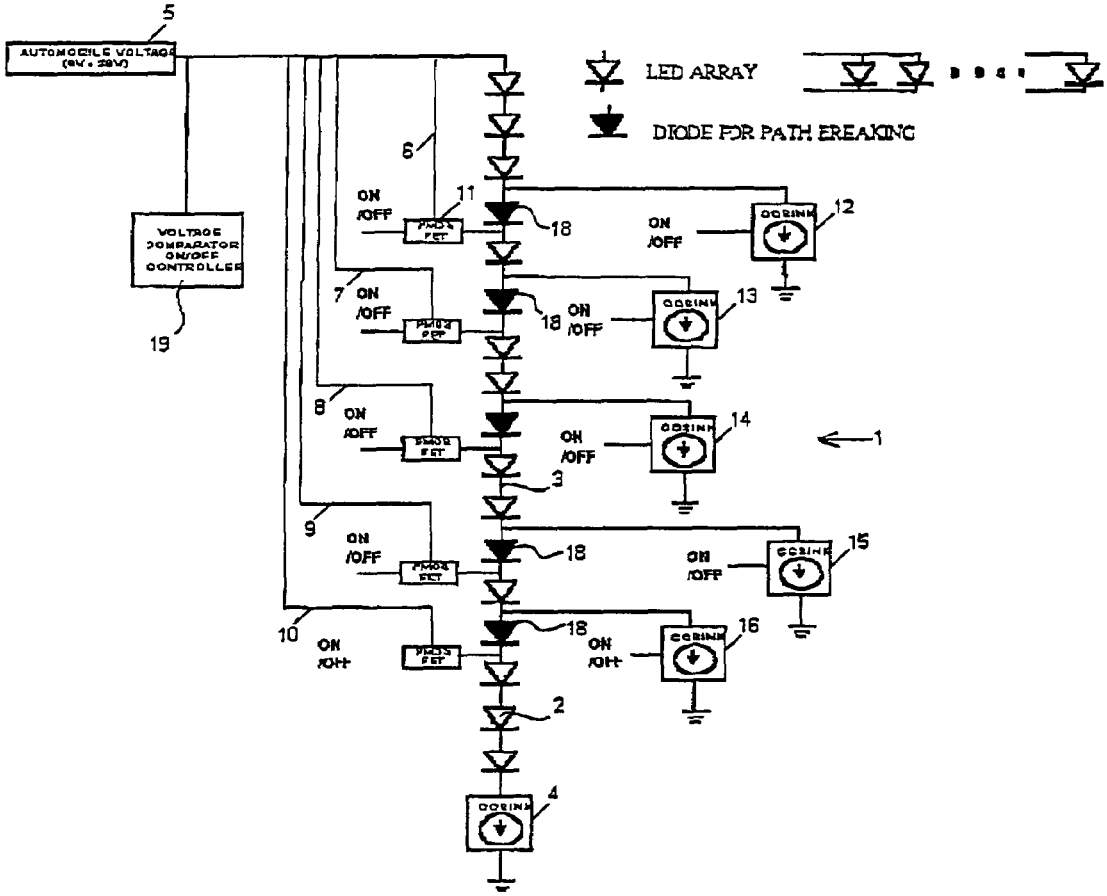
FIG. 1 shows a schematic diagram of a circuit in accordance with a preferred embodiment of the invention.

Referring to FIG. 1, a particular embodiment of a circuit 1 is shown.

In the circuit 1, a plurality of solid-state lighting devices in the form of LEDs 2 are provided.

The plurality of LEDs 2 are arranged in an array incorporating a serial path 3 through each of the LEDs and terminating in a constant current sink 4 or similar device. It will be apparent that, when connected to a power supply, each of the LEDs may operate and the constant current ink 4 is used to regulate the current and dissipate excess power supplied to the array. The power supply is indicated generally by the item 5 being a supply DC current which, in the case of automobiles or other uses, may be variable between different levels. This particular circuit is generally described with reference to automobile applications where the incoming voltage may be, for example, 6 volts to 26 volts.

In the embodiments described subsequently, reference will generally be made to a constant current sink or to a constant current device. It will be appreciated that these are particular forms of current regulating devices.

In the circuits of these embodiments, the LEDs are driven with a constant current continuously. It will be appreciated that the circuits may include pulse width modulating devices to drive the LEDs at different duty cycles. In such circuits, there may be a desire to increase the amplitude of the driving current with an associated change in the duty cycle for different circumstances. For example, the LEDs described in the circuit may be driven by a constant current of, for example, 20 mA. controlled by a constant current device. If a pulse width modulated driving current is used, the amplitude of that driving current may be regulated such that the duty cycle is, for example, 100% at 20 mA. or perhaps 70% at 30 mA. The variation in the duty cycle allows the LEDs to accommodate different voltages available in the circuit to perhaps further improve the efficiency.

Although the preferred embodiments described use a constant current device, it will be appreciated that a current regulator to choose specific currents and utilize pulse width modulation to equate the intensity is a specific option available to a circuit designer.

In addition to the serial path through the LEDs 2, at least one alternative path 6 is provided. In this particular embodiment, 5 parallel paths (6, 7, 8, 9 and 10) are provided although the particular number of parallel paths depends on the number of LEDs in the array and the particular uses and likely voltage variations to which the device may be put.

Each of the parallel paths such as path 6 is switchable by a suitable switch 11. This preferred embodiment utilizes P-channel metal oxide semiconductor field effect transistor (PMOSFET) switches although a variety of other switches could be used. These particular switches are selected due to the relatively small losses resulting through such switches.

Additional switchable constant current devices 12, 13, 14, 15 and 16 are provided. Each of these additional constant current devices is connected immediately prior to the point of interception of one of the parallel paths 6, 7, 8, 9 and 10 with the serial path 3. Furthermore, each of the constant current device connections is separated along the serial path from the parallel path by a path breaker 18 such as a diode or similar to inhibit current flowing directly from the parallel path 6 to the immediately prior constant current device 12.

A voltage sensor or similar means to calculate the incoming voltage and an associated controller 19 is provided to complete the circuit.

As will be seen already from FIG. 1, the circuit as provided gives both a serial path through each of the LEDs along path 3 as well as a number of alternative parallel paths through portions of the array.

To describe the array in use, references made to FIGS. 2, 3, 4 and 5 at which different input voltages are received and the circuit seeks to balance the power across different paths in the array.

Figure 2:
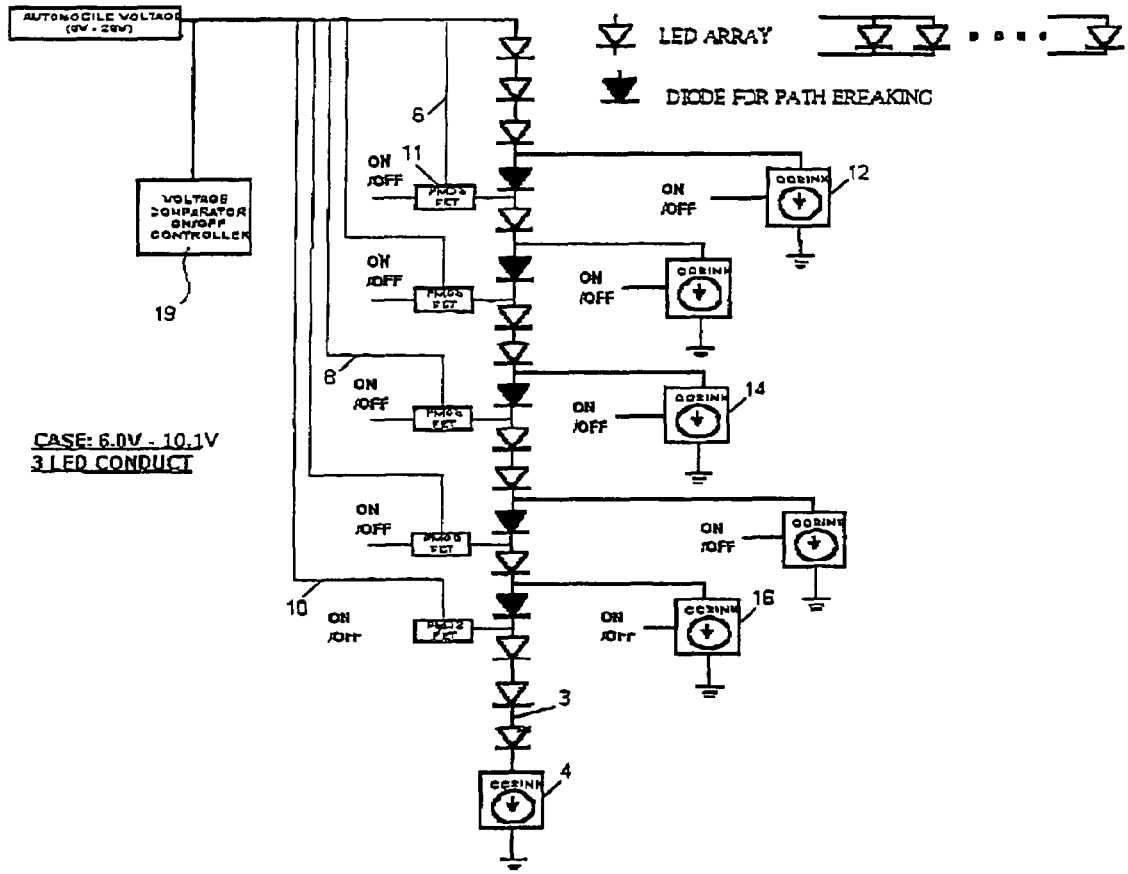
FIG. 2 shows a schematic drawing of the apparatus of FIG. 1 in a first configuration.

Referring to FIG. 2 in the first instance, an input voltage of between 6.0 and 10.1 volts is detected by the voltage sensor and controller 19. On noting a relatively low voltage, the switches 11 in parallel circuits 6, 8 and 10 are switched on together with the constant current devices 12, 14 and 16. The constant current device 4 at the end of the serial path 3 does not need to be switchable and is permanently left on.

As can be seen in FIG. 2, the array is now split into 4 parallel circuits, each containing 3 LEDs. In this manner, the voltage supply is dropped across 3 LEDs in each circuit and only a remaining voltage might be lost through the constant current sink in each of the circuits. If each LED has a voltage drop of approximately 2 volts, there will be minimal residual power lost through the constant current sink and only at slightly higher voltages, power is evenly dropped across all 4 operating constant current devices rather than concentrated in a single device.

A first path can be seen in FIG. 2 to comprise the first 3 LEDs that then terminate through the constant current device 12. A further circuit is provided along parallel path 6 and terminates at the constant current device 14. A yet further path is provided along the parallel path 8 and terminates at the constant current device 16 and a final path along parallel path 10 terminating in the constant current device 4.

The diodes provided in the circuit assist in acting as path breakers in the reverse direction.

Figure 3:
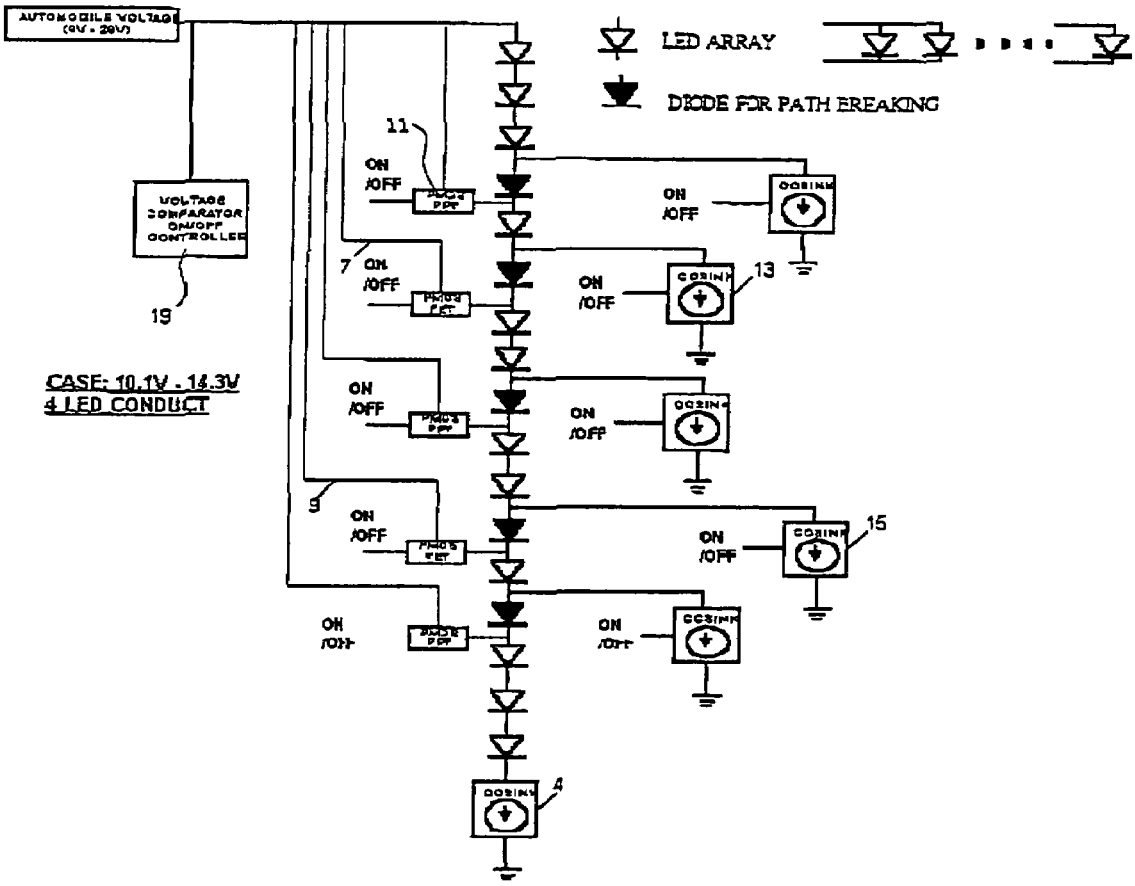
FIG. 3 shows a schematic diagram of the apparatus of FIG. 1 in a second configuration.

Referring to FIG. 3, a voltage of between 10.1 and 14.3 volts is detected by the controller 19. The controller 19 may operate switches 11 on paths 7 and 9 as shown to open these parallel paths while closing the other paths. Constant current devices 13, 15 and 4 are in operation and the others switched to "off". It can be seen that the array is now broken into 3 parallel circuits, each containing 4 operable LEDs. The first path terminates with the constant current device 13, a second path is opened along parallel path 7 and terminates a constant current device 15 and the third path along parallel path 9 and terminates at the constant current device 4.

With 4 LEDs in each parallel path, a greater voltage drop occurs through the increased number of LEDs and again only leaving residual power to be drawn by the constant current sinks.

Figure 4:
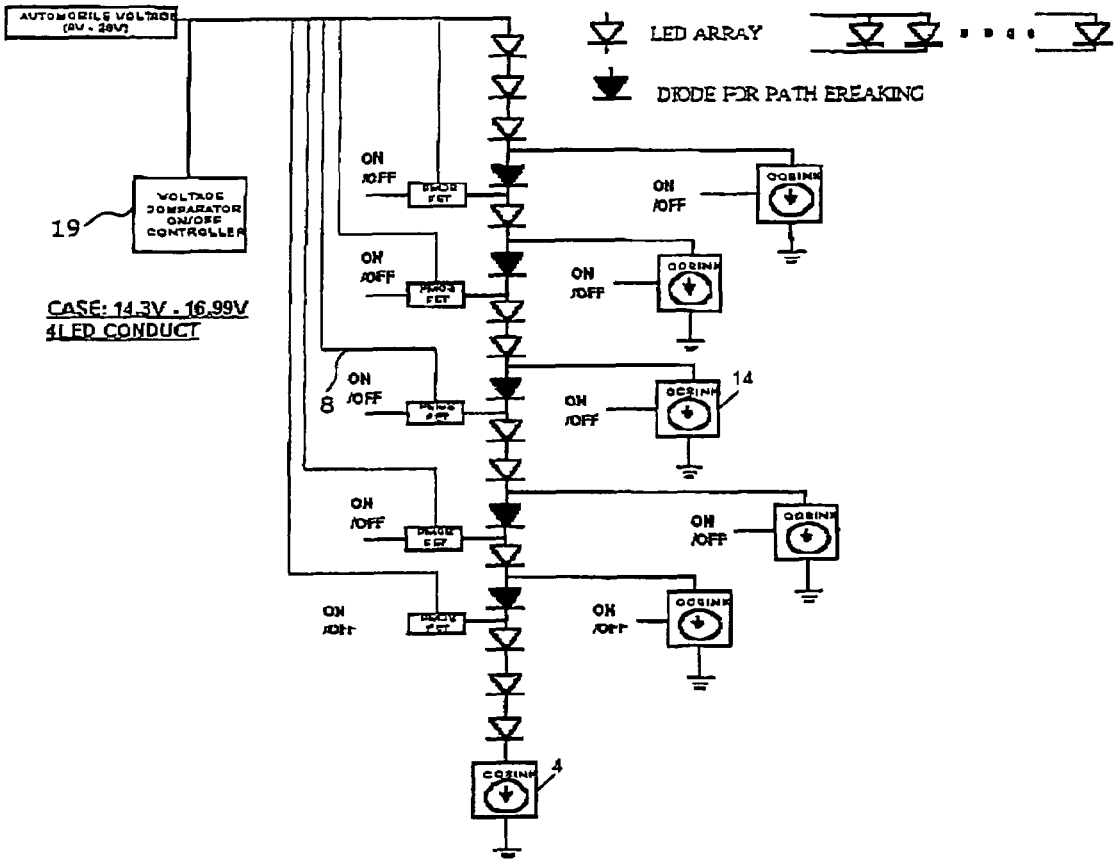
FIG. 4 shows a schematic view of the apparatus of FIG. 1 in a third configuration.

Referring now to FIG. 4, it can be seen that only path 8 and constant current sinks 14 and 4 are in an operable condition with the detector and controller 19 having received an indication of a voltage of 14.3 to 16.99 volts. Such an arrangement breaks the array into 2 paths, each containing 6 operable LEDs.

Figure 5:
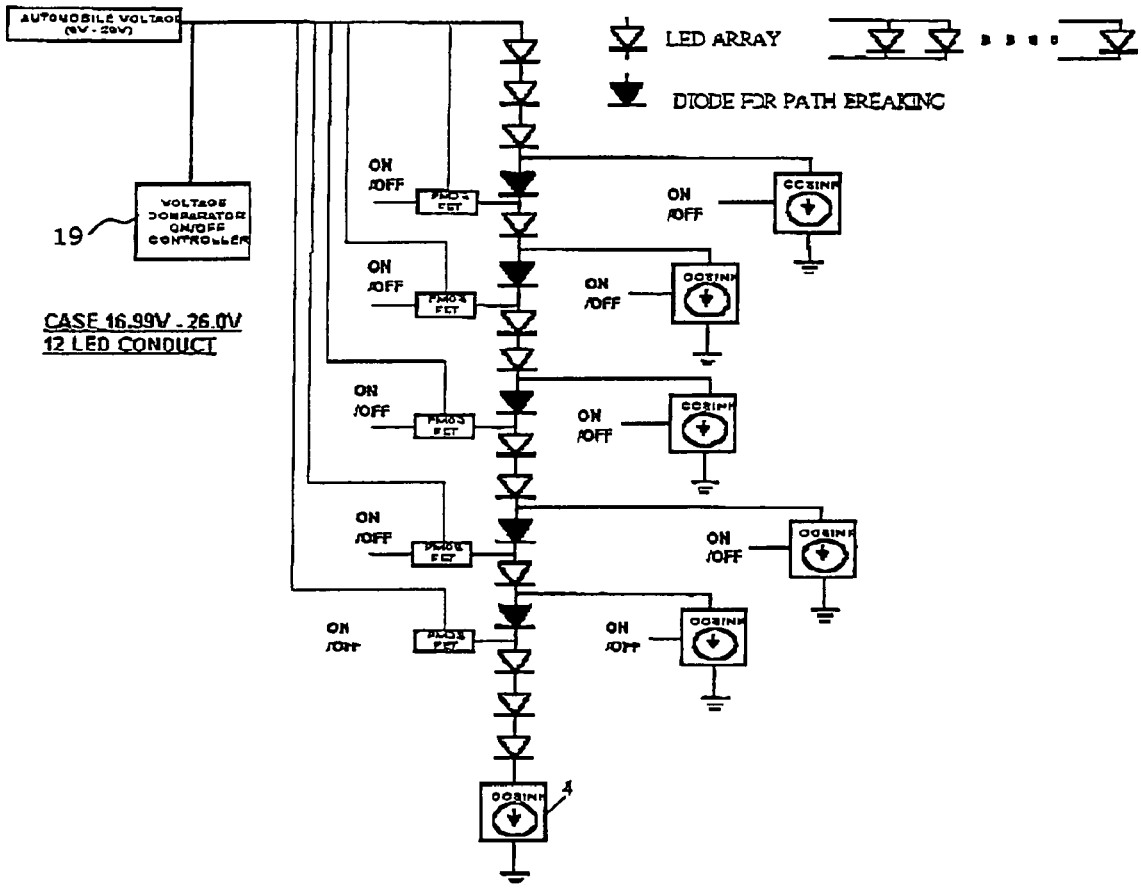
FIG. 5 shows a schematic diagram of the apparatus of FIG. 1 in a fourth configuration.

In the remaining FIG. 5, all the switchable parallel paths and switchable constant current devices are switched off with only the constant current device 4 at the end of a serial path for the arrays being in operation. This situation occurs upon the controller 19 receiving an indication of voltages between 16.99 and 26.0 volts so that all 12 LEDs are in a single current path to minimize the residual power requiring to be drawn by the constant current sink 4.

Thus it can be seen that the circuit is manipulated into a different number of parallel paths to minimize residual power.

It is clearly preferred in the embodiments that the parallel paths provided allow approximately equal numbers of LEDs in each of the parallel paths to equally share the power supply and cause minimal even power drains at the constant current devices. However, such an arrangement assumes the demand of each LED to be the same. In other devices, they may not be the same and quantity of LEDs is not the determining factor. It is the load from each circuit or the residual power that should be balanced where possible.

Although this preferred form of the invention utilizes constant current sink devices, other constant current regulators could be used in such parallel circuits. Furthermore, it should be noted that the arrangement of the circuit may be quite different from that shown in the schematic diagram of the preferred embodiment. The aspect to be taken from the preferred embodiment is the use of multiple parallel paths that allow the circuit to be reconfigured with differing numbers of LEDs in each circuit with a constant current drain.

The reconfiguration involves switching upon sensing of the incoming voltage in this preferred embodiment. Again, it will be appreciated that other forms of detection could be used such as detecting the voltage at the constant current devices which, when higher than a specific threshold could indicate a desire to rearrange the circuit to incorporate one or more further LEDs into each of the parallel paths.

The invention provides a relatively simple circuit operating on a DC operation so that there is no electromagnetic interference from the circuit. As each of the LEDs is driven by a constant current device in the circuit, brightness of the lamp is unaffected in each of the different configurations. There remain 12 LEDs illuminated at a constant current in all of the variations described in FIGS. 2 to 5.

The circuit uses relatively few components that may be off the shelf components and can be mounted on a PCB with the LEDs themselves to provide a unit readably fitable to a vehicle or similar item.

Heat is released and distributed by a variety of components in this embodiment rather than being centralized and no large heat sink is required.

Figure 6:
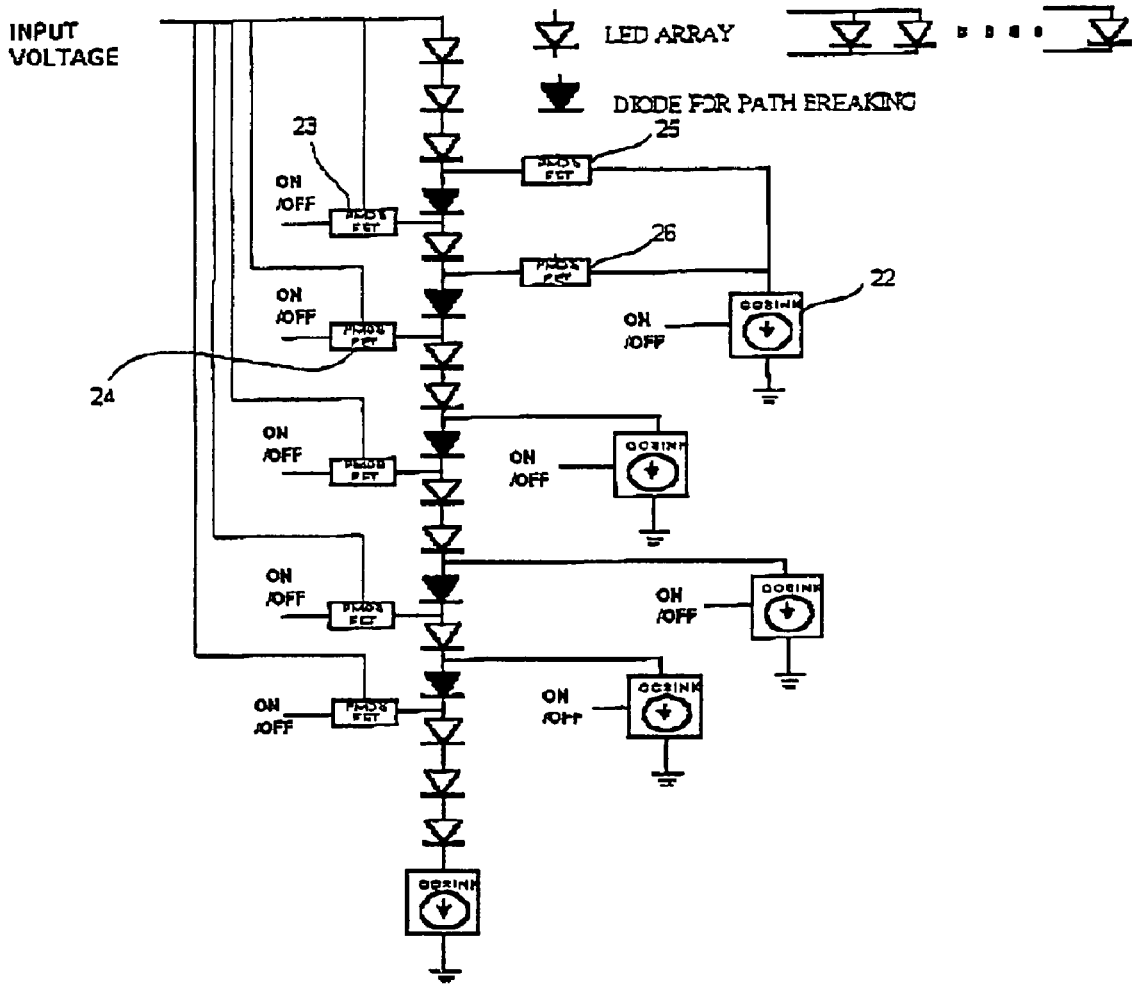
FIG. 6 shows a schematic diagram of a further embodiment of the apparatus.

A further embodiment is shown in FIG. 6. The circuit in this embodiment is generally the same as the previous embodiment with the same number of LEDs and current paths. However, it can be seen that the constant current devices 12 and 13 are combined into a single device 22. Additional switches, again preferably PMOS switches 25 and 26 are used on alternative paths to the device 22.

In operation, the switches 23, 24 may be operated in sync with the switches 25, 26 on the opposed side of the array. When it is desirable to have three LEDs in each circuit, switches 23 and 25 may be turned on to allow current to flow. To change the circuits such that four LEDs are in each circuit, switches 23 and 25 may be turned off and switches 24 and 26 may be turned on to shift the path of the current. In both cases, only a single constant current device 22 is needed as the switches bring this into each of the alternative circuit arrangements.

It will also be appreciated that similar switchable paths for the current could be used to make other constant current devices in the first embodiment redundant. Indeed, it will be apparent that a single constant current device could be in circuit with all the alternative current paths. However, although saving in components, such a solution reduces the number of devices dissipating heat when the voltage in each circuit is slightly higher than the drop caused by the optimal operation of the LEDs in that circuit. The choice between extra devices or extra need to deal with localized increases in heat may depend on the particular use of the circuit.

Thus it can be seen that the invention provides advantages over the prior art in these aspects.

What is claimed is:

1. A driving circuit for a solid-state lighting array comprising:

means for connection of said driving circuit to an incoming direct current power supply;

a plurality of solid-state lighting devices arranged in one series circuit with said means for connection to said direct current power supply;

at least one switchable parallel current path from said means for connection to said direct current power supply to an intermediate point along said one series circuit to form an alternative series circuit;

a first constant current device in the driving circuit in connection with said one series circuit for maintaining a first constant current flowing therethrough;

a voltage sensor;

a control means for controlling a first switch in said switchable parallel current path such that said plurality of solid-state lighting devices may be reconfigured into said alternative series circuit to alter the quantity of lighting devices in said one series circuit in response to changes in the voltage in said one series circuit, wherein said one series circuit and said alternative series circuit are connected in parallel upon said reconfiguration and wherein said one series circuit and said alternative series circuit contain a generally equated load from the lighting device after said reconfiguration such that the currents flowing through each said lighting device are at least substantially identical;

a second constant current device for maintaining a second constant current flowing therethrough; and a second switch for selectively connecting the second constant current device to said alternative series circuit upon reconfiguration of said plurality of lighting devices.

2. The driving circuit of claim 1, wherein the first and second constant current are at least substantially the same.

3. The driving circuit of claim 1, wherein the second switch is controlled by the control means.

* * * * *